United States Patent [19]

Kurosawa et al.

[11] 4,196,327

[45] Apr. 1, 1980

[54] VACUUM INTERRUPTER

[75] Inventors: Yukio Kurosawa; Yukio Kawakubo; Hiroyuki Sugawara, all of Hitachi, Japan

[73] Assignee: Hitachi, Ltd., Japan

[21] Appl. No.: 857,706

[22] Filed: Dec. 5, 1977

[30] Foreign Application Priority Data

Dec. 6, 1976 [JP] Japan ..... 51/14558

[51] Int. Cl.[2] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,935,406 | 1/1976 | Murano et al. | 200/144 B |
| 3,941,961 | 3/1976 | Kopplin | 200/144 B |
| 3,946,179 | 3/1976 | Murano et al. | 200/144 B |

*Primary Examiner*—Robert S. Macon

*Attorney, Agent, or Firm*—Craig and Antonelli

[57] ABSTRACT

A vacuum interrupter comprises a pair of opposed conductor rods extending exteriorlly of a vacuum vessel, a pair of main electrodes mounted to ends of the paired conductor rods and separable from each other, and coil electrodes which induce axial magnetic flux acting on arc produced when one main electrode separates from the other main electrode. The coil electrode includes a first arm section connected to the conductor rod and passing the current coming from one portion of the conductor rod radially thereof, a branching section for branching the current from the first arm section in reverse directions, and a second arm section for passing the branched currents until they are totalized again at the other portion of the conductor rod separated from the one portion by a spacer interposed between the first and second arm sections, whereby magnetic flux induced by the branched currents is cancelled out at the conductor rod, preventing the generation of eddy current in the conductor rod.

13 Claims, 12 Drawing Figures

VACUUM INTERRUPTER

This invention relates to a vacuum interrupter and especially to an improvement of the coil electrode for inducing magnetic fields oriented in parallel with arc generated in a gap between a pair of opposed electrode assemblies disposed in a vacuum vessel when they are separated or broken.

Generally, the vacuum interrupter has a cylindrical vacuum vessel and a pair of opposed electrode assemblies supported therein by means of conductor rods such extending exteriorly of the vacuum vessel. The paired electrode assemblies are normally closed for conduction of current flow but in the event of accident in the external circuit, they are separated in order to prevent damage of related apparatus. Upon the separation, between the opposed electrode assemblies is created an arc which has to be extinguished as fast as possible.

Today, vacuum interrupters with contrivance to extinguish arc have been proposed, as disclosed in U.S. Pat. Nos. 3,818,164 and 3,935,406 and Japanese patent application laid-open No. 52562/1975, according to which magnetic fields oriented in parallel with arc are applied thereto so as to dissipate the arc into numerous thin fiber-like segments.

More particularly, a coil electrode is provided behind a main electrode mounted to the end of a conductor rod. The coil electrode has a plurality of arm sections for passing the current coming from the conductor rod radially thereof, and arcuate sections for directing, circumferentially of the conductor rod, the current from the arm sections to looped current flows which in turn induce axial magnetic fields of the same polarity. The arm section includes subsections which abut to each other so that magnetic fields induced by radial currents flowing through the subsections may be cancelled out.

Namely, current flows through the subsections have the same magnitude but reverse palarity and a resultant magnetic field induced at the arm section is nullified. In other words, of magnetic fields produced by the coil electrode, those produced by the arcuate sections are available. In this manner, since magnetic fields produced by the arcuate sections of coil electrode as disclosed in the above-mentioned references are oriented axially with the same polarity, eddy current is created in the conductor rod and spacer. Especially, phase delay is caused by the eddy current at the central portion of the electrode and even after the interruption of current, eddy current sustains residual magnetic fields, not only degrading recovery of insulation but also causing overheating. Therefore, demand for prevention of eddy current is urgent.

An object of this invention is to provide a vacuum interrupter in which eddy current will not be created in a conductor rod by magnetic fields induced by circumferential current flows.

Another object of this invention is to provide a vacuum interrupter in which radial magnetic flux density is increased.

To attain these objects, a coil electrode of the invention comprises a first arm section for passing the current radially of a conductor rod, a branching section for branching the current from the first arm section circumferentially of the conductor rod in reverse directions, and a second arm section for passing the branched currents until they are totalized again at the conductor rod.

With this construction, magnetic fields induced by current flows through the branching sections are cancelled out at the conductor rod to thereby prevent the creation of eddy current in the conductor rod.

Figure 1:
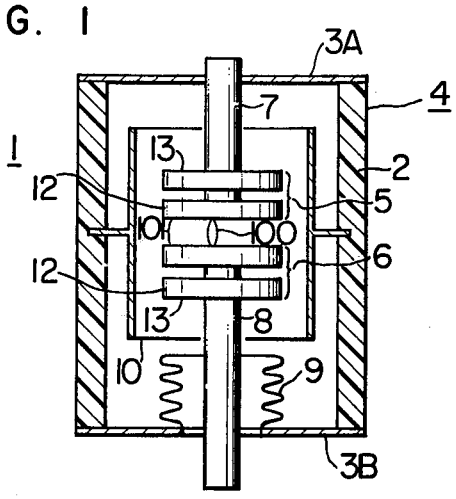
FIG. 1 is a longitudinal sectional view of a vacuum interrupter embodying the invention.

A vacuum interrupter 1 shown in FIG. 1 comprises a vacuum vessel 4 including a cylindrical insulating wall 2 and metallic end caps 3A and 3B for closing the ends of the cylindrical insulating wall, a stationary electrode assembly 5 and a movable electrode assembly 6 which are opposed within the vacuum vessel in a spearable fashion from each other, a conductor rod 7 extending from the rear surface of the stationary electrode assembly 5 to the exterior of the vacuum vessel, a conductor rod 8 extending, exteriorly of the vacuum vessel, from the rear surface of the movable electrode assembly 6, a metallic bellows 9 disposed between the conductor rod 8 and the end cap 3B and axially movable for making it possible to separate the movable electrode assembly 6 from the stationary electrode assembly 5, and a metallic intermediate shield 10 mounted to the inner surface of the cylindrical insulating wall to surround the two electrodes assemblies 5 and 6.

Figure 2:
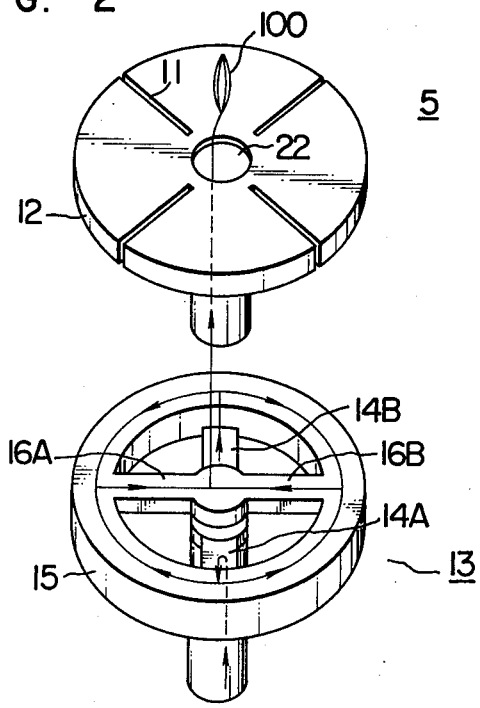
FIG. 2 is a perspective view of an electrode used in the vacuum interrupter of FIG. 1.
Figure 3:
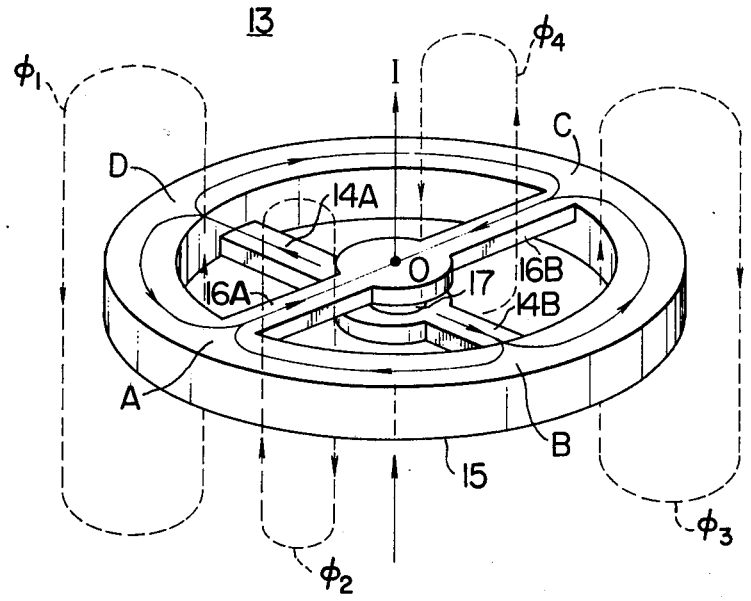
FIG. 3 is a detailed perspective view of a coil electrode.

A detailed structure of the stationary and movable electrode assemblies 5 and 6 will be described with reference to FIGS. 2 and 3 in which a description is given only of the stationary electrode assembly since both the electrode assemblies have the same structure.

The stationary electrode assembly 5 comprises a main electrode 12 connected to the conductor rod 7 and provided with a plurality of slots 11 formed radially of the conductor rod 7 and a recess 22, and a coil electrode 13 disposed behind the main electrode.

The coil electrode 13 comprises a first arm section 14 having two arms 14A and 14B each having one end connected to the conductor rod 7 and extending radially thereof, an annular branching section 15 connected to the other end of respective first arms, a second arm section 16 having two arms 16A and 16B each having one end connected to the branching section 15 at a location between the connecting points of the first arm section with the annular branching section 15 and the other end connected to the conductor rod 7, and a spacer 17 interposed between central portions of the first arm section 14 and second arm section 16.

Figure 4:
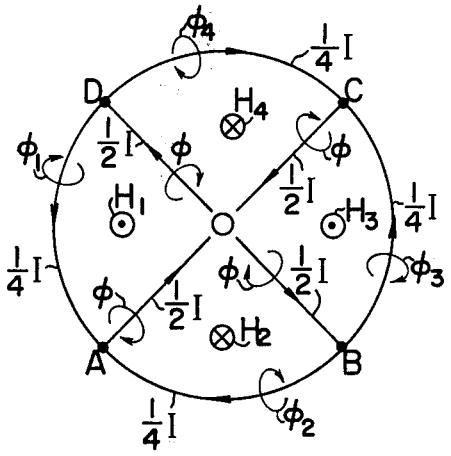
FIG. 4 is a diagram of explaining a trace of current flows in the electrode of FIG. 3.
Figure 12:
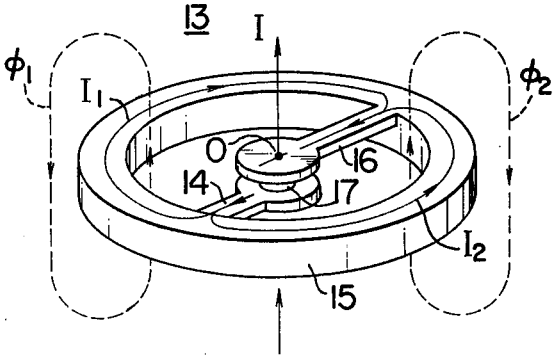

Each of the first and second arm sections 14 and 16 have two arms, but it may have more than two arms. When having a plurality of arms, in case of an even number of the arms, respective arms are arranged symmetrically with respect to the conductor rod, whereas in case of an odd number of the arms, respective arms are arranged asymmetrically with respect to the conductor rod, but with substantially the same angular space. When the first arm section 14 has a single arm and the second arm section 16 has a single arm, which arms are connected to the branching section 15 as shown in FIG. 12, the first and second arm sections 14 and 16 are arranged symmetrically with respect to the conductor rod so that substantially the same semicircular halves of the branching section may be provided. This is for allowing generation of magnetic field having the same magnitude in the righthand and lefthand side semicircular halves. Points A, B, C and D respectively correspond to locations where the arms 14A, 14B, 16A and 16B respectively join the branching section 15. The conductor rod 7 has a center designated at O and the coil electrode 13 defines, as shown in FIG. 4, areas AOB, BOC, COD and DOA which are equal to each other in their area. The spacer 17 serves to prevent a current flows through the first arm section 14 and second arm section 16 from being short-circuited across both the arm sections, and may be made of a stainless steel, for example.

An explanation will be made of the operation of the coil electrode hereinafter.

Initially, the two electrode assemblies 5 and 6 are closed. When the movable electrode assembly 6 is separated from the stationary electrode assembly 5 by driving an operation mechanism not shown, an arc 100 is produced between the main electrodes 12. A current I flowing in the conductor rod 7 is first passed radially of the conductor rod 7 through the first arms 14A and 14B, and then branched circumferentially of the conductor rod through the branching section 15. The current flows coming into the branching section through the opposite joints B and D and passed in the reverse directions enter the second arms 16A and 16B through the other opposite joints A and C and join at the conductor rod 7.

The current flow will be traced with reference to FIG. 4. A current of an amount of $\frac{1}{2}$ I is passed along each of the radii $\overline{OB}$ and $\overline{OD}$, branched circumferentially into current flows each having an amount of $\frac{1}{4}$ I through the joint B or D. The current flows each having the amount of $\frac{1}{4}$ I are added to each other at the joint A or C into a current of an amount of $\frac{1}{2}$ I. The current flows each having the amount of $\frac{1}{2}$ I pass through the radii $\overline{AO}$ and $\overline{CO}$ respectively into the center O resulting in a current of an amount of I which flows into the main electrode 12. This current trace is equivalent to a path which is established by arranging four sectoral coils 19 with a center including their rivets as shown in FIG. 6.

Magnetic flux $\Phi_1$, $\Phi_2$, $\Phi_3$ and $\Phi_4$, induced by the currents of $\frac{1}{4}$ I flowing through the sectoral coils 19 respectively, are oriented axially, that is, in parallel with the arc 100 in a gap 101 between the main electrodes 12, in such a manner the magnetic fluxes $\Phi_1$ and $\Phi_3$ cancel out the magnetic fluxes $\Phi_2$ and $\Phi_4$ respectively, thereby preventing generation of an eddy current in the conductor rod 7 and the spacer 17. More particularly, when considering magnetic fields $H_1$ to $H_4$ developing at the center O, among magnetomotive forces associated with arcuate portions $\overset{\frown}{AB}$, $\overset{\frown}{BC}$, $\overset{\frown}{CD}$ and $\overset{\frown}{DA}$, the magnetomotive forces associated with the portions $\overset{\frown}{AB}$ and $\overset{\frown}{CD}$ have the same magnitude as but reverse polarity to those associated with the portions $\overset{\frown}{BC}$ and $\overset{\frown}{DA}$, thereby cancelling with each other, so that a resultant magnetomotive force at the center O is nullified. Further, magnetomotive forces associated with the radii $\overline{AO}$ and $\overline{CO}$ as well as those associated with the radii $\overline{BO}$ and $\overline{DO}$ are cancelled out at the center O. Consequently, no magnetomotive force develops at the center O and the magnetic field at the center axis of the electrode is nullified. Therefore, even immediately after the interruption of a current, it of course holds true that no magnetic field develops at the center O.

Figure 5:
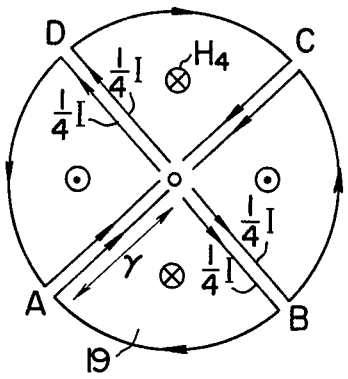
FIG. 5 is a diagram showing a coil arrangement equivalent to FIG. 4.
Figure 6:
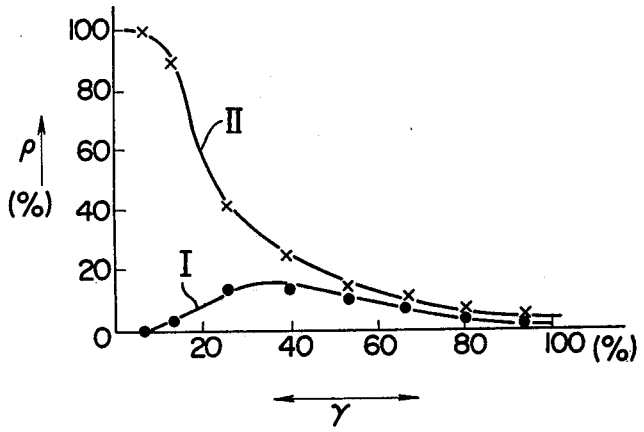
FIG. 6 is a graphic representation showing the magnitude of residual magnetic field in relation to the radius of current interruption.

FIG. 6 represents experimental results for showing residual magnetic field intensity immediately after interruption of a current, where the abscissa represents values of radius $\gamma$ shown in FIG. 5 ranging from the center O to the circle including the joint A, B, C and D at which $\gamma$ is 100% and the ordinate represents magnetic flux density $\rho$. Curve I indicates the characteristic of the electrode assembly according to the present invention and curve II indicates the characteristic according to the prior art. As clearly be seen from FIG. 6, the residual magnetic field is zero or very small in the neighbourhood of the axis of the electrode assembly.

Figure 7:
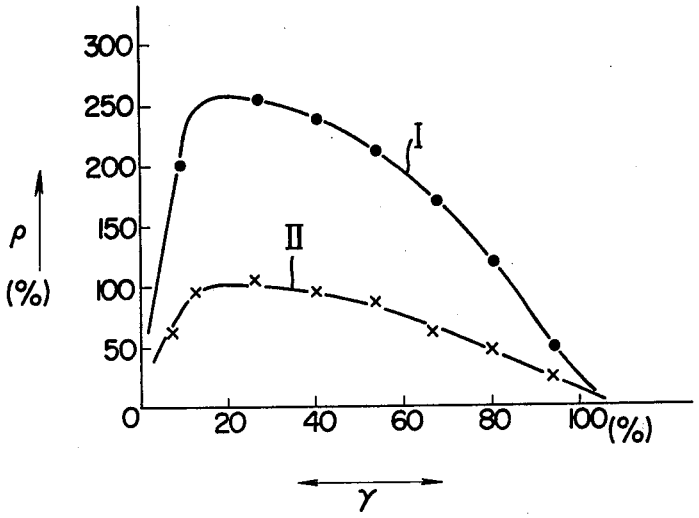
FIG. 7 is a graphic representation showing radial magnetic flux density induced by peak currents.

On the other hand, it is possible for the coil electrode 13 to produce magnetic flux $\Phi$ by current flows through the first arms 14A and 14B and the second arms 16A and 16B. Accordingly, a large axial magnetic flux density can be obtained along the radius, which is shown in FIG. 7. In FIG. 7, the abscissa is the same as that of FIG. 6 and the ordinate represents magnetic flux density $\rho$ along the radius. Curve I indicates the characteristic according to the present invention and curve II indicates the characteristic according to the prior art. Such a large magnetic flux density is very effective for dissipating metallic vapor molecules created by the arc, which results in that a local overheating may hardly be caused and a larger current may be interrupted.

In this embodiment, the coil electrode is provided in each of the stationary and movable electrode assemblies but alternatively, may be provided in one of these electrode assemblies with the same operational effect.

Referring to FIGS. 8 through 12, further embodiments of the invention will be described.

Figure 8:
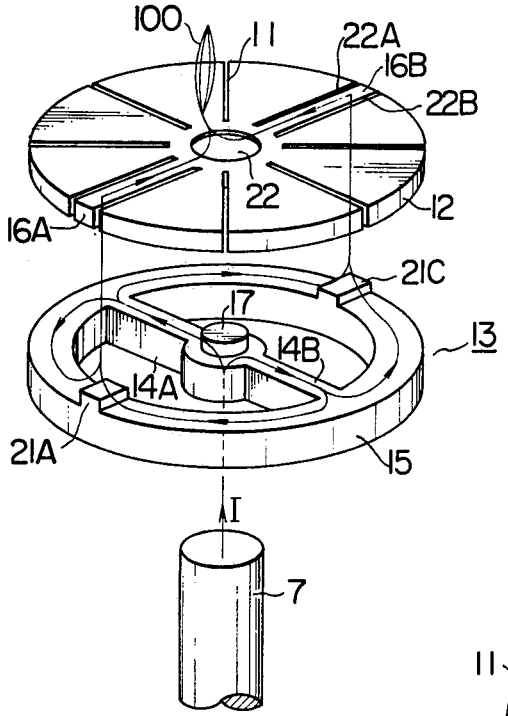
FIGS. 8 through 12 are perspective views of other embodiments of the invention.

FIG. 8 shows another embodiment wherein embossments 21A and 21B are provided on the branching section 15 at locations between joints where the two first arms 14A and 14B join the branching section. The main electrode 12 is formed with radial grooves 22A and 22B and includes the arms 16A and 16B of the second arm section, which are formed between the grooves 22A and 22B and adjoined on the embossments 21A and 21B respectively. The main electrode 12 is disposed on the spacer 17 and fixed thereon. With this construction, the coil electrode 13 is easy to be fabricated, since the second arms 16A and 16B are not provided on the coil electrode 13 but formed on the main electrode 12.

Figure 9:
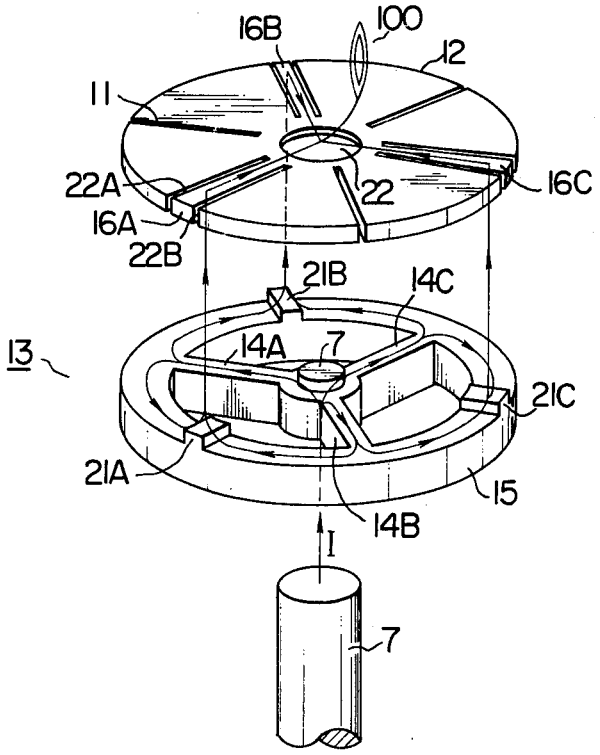

In another embodiment as shown in FIG. 9, three embossments 21A, 21B and 21C are provided on the branching section 15 at locations between joints where the first arms 14A, 14B and 14C join the branching section, and the second arms 16A, 16B and 16C are provided on the main electrode 12 similarly to the embodiment of FIG. 8 in correspondence with the embossments 21A, 21B and 21C, respectively. With this construction the density of axial magnetic flux induced by currents flowing in the radial direction can be increased.

Figure 10:
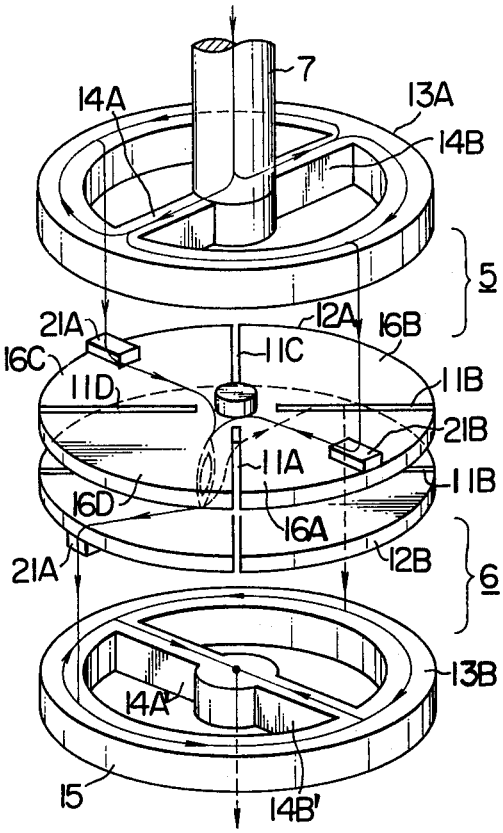

In still another embodiment as shown in FIG. 10, the stationary electrode assembly 5 is constituted by the main electrode 12A formed with a sectoral second arm section having arms 16A, 16B, 16C and 16D extenting between the slots 11A, 11B, 11C and 11D and by the coil electrode 13A. The stationary electrode assembly 5 thus constructed is opposed to the movable electrode assembly 6 composed of the main electrode 12B and the coil electrode 13B which have substantially the same construction as the main electrode 12A and the coil electrode 13A. The first arm section, having the arms 14A and 14B, of the coil electrode 13A and the first arm section, having the arms 14A' and 14B', of the coil electrode 13B are circumferentially offset, i.e. are disposed to form a cross-configuration so that they establish substantially the same arrangement as shown in FIG. 3. According to this embodiment, merely by providing the single first arm section having the two arms in each of the coil electrodes, the same operational effect as that obtained by two first arm sections having for arms provided in one coil electrode can be attained so that axial magnetic flux density can be increased with a simple construction of the coil electrode. Needless to say, a similar operational effect can be achieved even if not the first arms 14A, 14B, 14A' and 14B' but the second arms 16A, 16B, 16C and 16D of respective main electrodes 12A and 12B are offset circumferentially.

Figure 11:
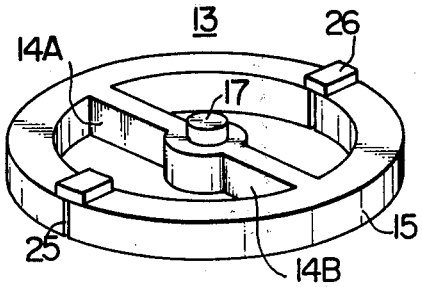

FIG. 11 shows another structure of the coil electrode 13 wherein the annular branching section 15 is formed with gaps 25 at locations between joints where the first arms 14A and 14B join the branching section, electrically conductive spacers 26 bridge the gaps 25 to form electrically closed circuits, and the second arms are connected to the spacers 26. With this structure, it becomes easy to form the configuration of the arms 14A and 14B and the annular section 15, because a tool such as band-saw for forming such configuration can enter into within the annular section 15 through the gaps 25.

FIG. 12 shows another structure of the coil electrode 13, in which the first arm section has a single arm 14 which joins the branching section 15 at a location thereof and the second arm section also has a single arm 16 which joins the branching section 15 at the opposite location. The first and second arms meet with each other at the center of the annular branching section with the spacer 17 interposed between these arms. Righthand and lefthand semicircular halves of the annular branching section 15, through which current $I_1$ and $I_2$ flow, have the same semicircular length so that the current $I_1$ is equal to the current $I_2$ in magnitude and hence the density of the magnetic flux $\Phi_1$ is equal to that of the magnetic flux $\Phi_2$. Such a structure as shown in FIG. 12 is applicable to the embodiments shown in FIGS. 8 through 11.

As will be understood from the foregoing description, a current flowing into the coil electrode is passed in the radial direction through the first arm section and then branched in the reverse directions through the branching section, so that magnetic flux induced by this current flow is nullified at the conductor rod, preventing over-heating due to an eddy current in the conductor rod.

What we claim is:

1. A vacuum interrupter comprising a vacuum vessel, a pair of conductor rods extending exteriorly of the vacuum vessel, and a pair of electrode assemblies respectively connected to the conductor rods within the vacuum vessel, each of said electrode assemblies having a main electrode from which arc may be ignited, at least one of these main electrodes being electrically connected with a coil electrode for passing a current coming thereinto from an associated one of the conductor rods in such a manner that the current induces axial magnetic flux, wherein said coil electrode comprises:

(a) a plurality of first arms connected to the conductor rod and passing the current radially of the conductor rod;

(b) an annular branching section connected to the first arms and branching the current coming from the first arms circumferentially of the conductor rod in reverse directions;

(c) a plurality of second arms for combining the branched currents and passing the combined current toward the conductor rod; and (d) a spacer interposed between the first and second arms for preventing short-circuiting between the first and second arms.

2. A vacuum interrupter according to claim 1, wherein said second arms join said branching section at the midst of circular arcs of said branching section defined by joints where said first arms connected to said conductor rod join the branching section, said second arms being coplanar with said main electrode.

3. A vacuum interrupter according to claim 1, wherein said second arms are disposed in correspondence with gaps formed in said branching section between adjacent joints where adjacent said first arms join said branching section.

4. A vacuum interrupter according to claim 1, wherein said branching section is partitioned by gaps and electrically conductive spacers bridge the gaps.

5. A vacuum interrupter according to claim 1, in which each of said pair of electrode assemblies comprises said coil electrode, wherein either one of said first arms and second arms of one of said electrode assemblies are circumferentially offset from those of the other electrode assembly.

6. A vacuum interrupter according to claim 1, in which each of said electrode assemblies comprises said coil electrode, wherein said second arms are provided between grooves formed on the main electrode, and either one of said first arms and said second arms of one of said electrode assemblies are circumferentially offset from those of the other electrode assembly.

7. A vacuum interrupter comprising a vacuum vessel, a pair of conductor rods extending exteriorly of the vacuum vessel, and a pair of electrode assemblies respectively connected to the conductor rods within the vacuum vessel, each of said electrode assemblies having a main electrode from which arc may be ignited, at least one of these main electrodes being electrically connected with a coil electrode for passing a current coming thereinto from an associated one of the conductor rods in such a manner that the current induces axial magnetic flux, wherein said coil electrode comprises:

(a) a single first arm connected to the conductor rod and passing the current radially of the conductor rod;

(b) an annular branching section connected to the first arm and branching the current coming from the first arm circumferentially of the conductor rod in reverse directions;

(c) a single second arm for combining the branched currents and passing the combined current toward the conductor rod; and (d) a spacer interposed between the first and second arms for preventing short-circuiting between the first and second arms.

8. A vacuum interrupter according to claim 7, wherein said second arm is provided between grooves formed on the main electrode between a portion of said branching section opposite to the first arm and said conductor rod.

9. A vacuum interrupter according to claim 7, wherein a gap is formed in the branching section at a location opposite to the first arm, and said second arm is provided, in correspondence with said gap, between grooves formed on the main electrode between the corresponding portion of the branching section and said conductor rod.

10. A vacuum interrupter according to claim 7, wherein said branching section is partitioned by a gap and an electrically conductive spacer bridges the gap.

11. A vacuum interrupter according to claim 1, in which each of said electrode assemblies comprises said coil electrode, wherein either one of said first arms and second arms of one of said electrode assemblies are circumferentially offset from those of the other electrode assembly, and said first arms of one electrode assembly are in register with those of the coil electrode of the other electrode assembly.

12. A vacuum interrupter according to claim 1, in which each of said electrode assemblies comprises said coil electrode, wherein said first arms of one of said electrode assemblies are circumferentially offset from those of the other electrode assembly, said first arm projected in the axial direction being positioned in the midst between adjacent said first arms of said other electrode assembly.

13. A vacuum interrupter according to claim 1, in which each of said electrode assemblies comprises said coil electrode, wherein said second arms are provided grooves formed on the main electrode, and either one of said first arms and said second arms of one of said electrode assemblies are circumferentially offset from those of the other electrode assembly in such a manner that the first arms of one of the electrode assemblies are in register with the second arms of the other electrode assembly.

* * * * *